US007460093B2

(12) United States Patent
Ozawa et al.

(10) Patent No.: US 7,460,093 B2
(45) Date of Patent: Dec. 2, 2008

(54) ELECTRONIC CIRCUIT, DRIVING METHOD THEREOF, ELECTRO-OPTICAL DEVICE, AND ELECTRONIC APPARATUS

(75) Inventors: Tokuro Ozawa, Suwa (JP); Eiji Kanda, Suwa (JP); Ryoichi Nozawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 615 days.

(21) Appl. No.: 11/091,544

(22) Filed: Mar. 29, 2005

(65) Prior Publication Data

US 2005/0237283 A1 Oct. 27, 2005

(30) Foreign Application Priority Data

Apr. 22, 2004 (JP) ..... 2004-126932

(51) Int. Cl.
*G09G 3/30* (2006.01)

(52) U.S. Cl. ..... 345/76

(58) Field of Classification Search ..... 345/76–83
See application file for complete search history.

(56) References Cited

U.S. PATENT DOCUMENTS 6,229,506 B1 5/2001 Dawson et al.
2003/0122745 A1 7/2003 Miyazawa
2005/0088378 A1 * 4/2005 Ozawa et al. ..... 345/76

FOREIGN PATENT DOCUMENTS

JP A 2003-177709 6/2003
KR 2004-9285 1/2004

OTHER PUBLICATIONS

U.S. Appl. No. 10/923,725, filed Aug. 24, 2004, Ozawa et al.

* cited by examiner

*Primary Examiner*—Richard Hjerpe
*Assistant Examiner*—Michael Pervan
(74) *Attorney, Agent, or Firm*—Oliff & Berridge, PLC

(57) ABSTRACT

To reduce a time for applying a target voltage to a gate of a driving transistor. During an initializing period, both ends of a capacitive element become a short-circuited state by turning on transistors, so that node A and B becomes a voltage made by subtracting the threshold voltage $V_{thp}$ of the driving transistor from a power source voltage $V_{EL}$. During a writing period, the transistor is turned on and a data signal X-j is supplied to change the voltage at the node B as much as a voltage corresponding the current which is to flow into an OLED element. The node A is changed from the threshold voltage as much as the value obtained by dividing the voltage change by capacity ratio. During a light-emitting period, the transistor is turned on, so that the current corresponding to the voltage at the node A flows through the OLED element.

11 Claims, 16 Drawing Sheets

(1a) INITIALIZATION PERIOD (1a) INITIALIZATION PERIOD (1b) INITIALIZATION PERIOD (2) WRITING PERIOD (3) LIGHT-EMITTING MAINTAINING PERIOD (1) INITIALIZING PERIOD (2) WRITING PERIOD (3) LIGHT-EMITTING MAINTAINING PERIOD

ELECTRONIC CIRCUIT, DRIVING METHOD THEREOF, ELECTRO-OPTICAL DEVICE, AND ELECTRONIC APPARATUS

BACKGROUND

The present invention relates to an electronic circuit, a driving method thereof, an electro-optical device and electronic apparatus, which drives an electrical current-driving type element such as an organic light-emitting diode element.

In recent years, an organic light-emitting diode (hereinafter, referred to as OLED), which is called as an organic electroluminescent element or a light-emitting polymer element, has been drawing attention as a next generation light-emitting device that replaces a liquid crystal display device. The OLED element has low viewing angle dependency because it is a self-luminous type, and it does not need a backlight or a reflected light. On this accounts, it has excellent characteristics as a display panel, such as wide viewing angle, low power consumption and adaptability to being made thin.

Herein, the OLED element is an electrical current type passive driving element in which a light-emitting state can not be maintained when the electrical current is cut off, because it does not have a voltage holding characteristic like a liquid crystal element. For this reason, when the OLED element is driven in an active matrix method, a configuration is generally used in which a voltage corresponding to gray scale of a pixel is applied to a gate of a driving transistor, the voltage is hold by the gate capacitance, and a current corresponding to the gate voltage is input to the OLED element by the driving transistor, during a writing period (selection period).

By the way, in such a configuration, as a threshold voltage characteristic of the driving transistor is deviated, the brightness of the OLED element is different for each pixel, and accordingly it has been pointed out that the display quality is deteriorated. In order to solve the problem, recently, techniques has been suggested that during the writing period, the corresponding driving transistor is connected to a diode and a constant current is input to a data line from the driving transistor, and thereby it is programmed that the gate of the driving transistor is applied with a voltage corresponding to the current to flow into the OLED element to compensate for the deviation of the threshold voltage characteristic of the driving transistor (for example, see Patent Documents 1 and 2).

[Patent Document 1] U.S. Pat. No. 6,229,506 (see FIG. 2)

[Patent Document 2] Japanese Unexamined Patent Application Publication No. 2003-177709 (see FIG. 3)

However, according to the techniques, in a case that the driving transistor is a p-channel type, during the writing period, when a current flowing into the OLED element is set in a small amount, the gate voltage of the driving transistor is high, so that a current between the source and drain of the driving transistor is in a state in which it is difficult to flow. For this reason, it has been newly pointed out that the required voltage cannot be applied to the gate of the driving transistor during the writing period.

The present invention is designed to solve the above-mentioned problems, and it is an object of the present invention to provide an electronic circuit, a driving method thereof, an electro-optical device, and electronic apparatus, which are capable of applying to the gate of the driving transistor a voltage corresponding to the current which is to flow into a passive driving element.

SUMMARY

In order to achieve the above-mentioned objects, the present invention provides a method of driving an electronic circuit comprising: a driving transistor for controlling a current flowing through a driven element; a first switching element for turning on or off between a gate and a drain of the driving transistor; a capacitive element one end of which is connected to the gate of the driving transistor; a second switching element for turning on or off between the other end of the capacitive element and the drain of the driving transistor; a third switching element for turning on or off between a signal line and the other end of the capacitive element; and a fourth switching element for cutting off the current flowing through the driven element when turned off, regardless of the control of the driving transistor, wherein the method comprises: a first step of turning on at least the first and second switching elements, and then turning off the first and second switching elements; a second step of applying to the signal line a voltage corresponding to a current which is to flow into the driven element while the third switching is turned on; a third step of turning off the third switching element, and making the driving transistor keep flowing the current corresponding to the gate voltage of the driving transistor through the driven element by maintaining the fourth switching element in the on-state. According to this method, the driving transistor is diode-connected by turning on the first switching element, and both ends of the capacitive element are short-circuited and the voltage maintaining state of the capacitive element is cleared by turning on the second switching element 212, thereby one end of the capacitive element and the gate (node A) of the driving transistor and the other end (node B) of the capacitive element become a voltage corresponding to the threshold voltage of the driving transistor. Then, the first and second transistors are turned off, so that the node A is maintained in the voltage corresponding to the threshold voltage (first step). Next, in the second step, the node B is changed to the voltage (the voltage corresponding to the current which is to flow into the driven element) applied to the data line, so that the voltage at node A is changed as much as the changed voltage and maintained. In the third step, the current corresponding to the voltage at node A after being changed keeps flowing through the driven element, but in the flowing current, the threshold characteristic of the driving transistor is cancelled. In addition, in the second step, since the voltage corresponding to the current which is to flow into the driven element is applied to the other end of the capacitive element, it does not need to be directly applied to the gate of the driving transistor, thereby a time required for applying the corresponding voltage can be shorten.

In the present invention, in the first step, it is possible to turn off the second switching element, and then to turn off the first switching element. In this way, when the second and first switching elements are turned off in turn, the node A can reliably become the voltage corresponding to the threshold of the driving transistor.

Also, according to the present invention, the first and second switching elements are turned on substantially at the same time, and the third switching element is turned on to flow a current between the source and the drain of the driving transistor, and then the first and second switching elements are turned off substantially at the same time. In this method, since on and off of the first and second switching element are commonly controlled, it is possible to reduce the number of control lines in the electronic circuit.

In order to achieve the above-mentioned objects, the present invention provides an electronic circuit comprising: a driving transistor for controlling a current flowing through a driven element; a first switching element turned on during a first period and turned off during second and third periods, between a gate and a drain of the driving transistor; a capacitive element one end of which is connected to the gate of the driving transistor; a second switching element at least turned on at a starting point of time of the first period and turned off during the second and third periods, between the other end of the capacitive element and the drain of the driving transistor; a third switching element for turning on a voltage corresponding to a current which is to flow into the driving device during the second period, between the other end of the capacitive element and a signal line applied during the second period; and a fourth switching element turned off during a first period and turned on during second and third periods, for cutting off the current flowing through the driven element when turned off, regardless of the control of the driving transistor. According to the electronic circuit, it is possible to flow a current into the driven element without depending on the threshold characteristic of the driving transistor, and to make short a time required for applying the voltage corresponding to the current.

In the electronic circuit, the first and fourth switching elements are different conductivity transistor, and their gates are connected to a common control line. According to this configuration, the control number for controlling the electronic circuit can be reduced by one.

In this configuration, it is preferable that the second switching element is the same conductivity transistor as the fourth switching element, and the gate of the second switching element is also commonly connected to the control line. Thereby, the control line for controlling the electronic circuit can be further reduced by one line.

Of course, the first to fourth switching elements may be all transistors, and their gates may be connected to different control line.

In addition, in the electronic circuit, it is preferable that the driven element is an electro-optical element, particularly, an organic light-emitting diode element.

In order to achieve the above-mentioned objects, the present invention provides an electro-optical apparatus having a pixel circuit at an intersection of a scan line and a data line, the scan line being sequentially selected, and the data line having applied thereto a voltage corresponding to a current which is to flow into an electro-optical element, wherein, the pixel circuit comprises: a driving transistor for controlling a current flowing through the electro-optical element; a first switching element turned on during a first period and turned off during second and third periods, between a gate and a drain of the driving transistor; a capacitive element one end of which is connected to the gate of the driving transistor; a second switching element at least turned on at a starting point of time of the first period and turned off during the second and third periods, between the other end of the capacitive element and the drain of the driving transistor; a third switching element turned on during the second period between the data line and the other end of the capacitive element; and a fourth switching element turned off during a first period and turned on during second and third periods, for cutting off the current flowing through the electro-optical element when turned off, regardless of the control of the driving transistor. According to the electro-optical apparatus, it is possible to flow a current not depending on the threshold characteristic of the driving transistor into the electro-optical element, and to make short a time required for applying the voltage corresponding to the current.

Further, it is preferable that the electronic apparatus according to the present invention has the electro-optical apparatus.

DETAILED DESCRIPTION OF EMBODIMENTS

Hereinafter, embodiments of the present invention will be described with reference to the accompanying drawings.

First Embodiment

Figure 1:
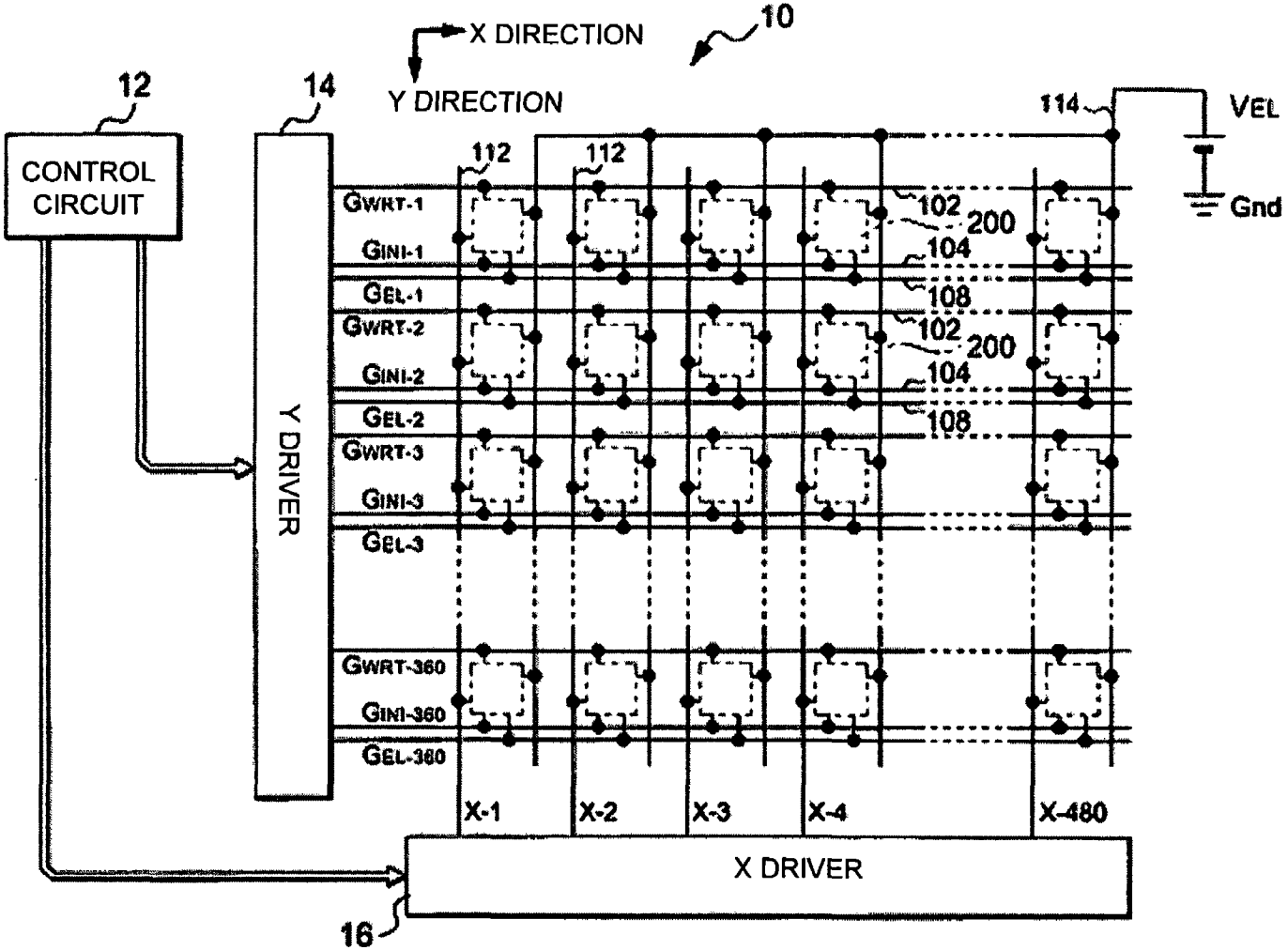
FIG. 1 is a block diagram illustrating a configuration of an electro-optical device according to the first embodiment of the present invention.

FIG. 1 is a block diagram representing a configuration of the electro-optical device according to the first embodiment of the present invention.

As shown in this Figure, in the electro-optical device 10, a plurality of scan lines 102 are successively provided in a horizontal direction (X direction), and a plurality of data lines (signal lines) 112 is successively provided in a vertical direction (Y direction). Also, pixel circuit (electronic circuit) 200 is provided so as to correspond to each of the intersections of the scan lines 102 and the data lines 112.

Herein, for the sake of explanation, it is assumed that the number of the scan line 102 (the number of rows) is 360 and the number of data lines (the number of columns) is 480 so that the pixel circuit 200 has a structure arranged in a matrix shape of 360 rows×480 columns. However, the present invention is not limited thereto.

Moreover, in the arrangement of the pixel circuit 200, control lines 104, 108 are provided to each of rows in the X direction in parallel to the scan line 102. Accordingly, the scan line 102, the control line 104 and 108 become 1 set, so that they are used together for one line pixel circuits 200.

Further, the pixel circuit 200 includes OLED element described below, and a predetermined image is displayed in a gray scale by controlling a current toward the OLED element for every pixel circuit 200.

Y driver 14 selects the scan line 102 by one row for each horizontal scan period, supplies a scan signal having H level to the selected scan line 102, and supplies various control signals synchronized with the selection to the control line 104 and 108. That is, the Y driver 14 supplies a scan signal or a control signal to the scan line 102, the control line 104 and 108 for each of rows.

Herein, for the sake of explanation, a scan signal supplied to the scan line 102 of i-th row (i is an integer of $1 \leqq I \leqq 360$, which represents that a row is generalized) is denoted by $G_{WRT-i}$. Similarly, control signals supplied to the control lines 104 and 108 of i-th row are denoted by $G_{INI-i}$ and $G_{EL-i}$.

On the other hand, X driver 16 supplies a data signal of the voltage corresponding to a current which is to flow into the OLED element of the pixel circuit 200, to one-row pixel circuits corresponding to the scan line 102 selected by the Y driver 14, i.e., each of the pixel circuits 200 of 1 st to 480th row located at the selected row, through the $1^{st}$ to 480th data lines 112. Herein, the data signal is designated such that a pixel becomes brighter as a voltage gets lower, while it becomes darker as the voltage gets higher.

In addition, for the sake of explanation, the data signal supplied to the data line 112 of j-th row (j is an integer of $1 \leqq I \leqq 480$, which represents that a column is generalized) is denoted by X-j.

Further, a high potential voltage $V_{EL}$ being a power source of the OLED element is supplied to all pixel circuits 200 through a power line 114. Further, all pixel circuits 200 are commonly grounded to the voltage reference potential Gnd.

In addition, the voltage at the data signal X-j designating a black color, which is the lowest gray level of pixel, is set to be lower than $V_{EL}$, and the voltage at the data signal X-j designating a white color, which is the highest gray level of pixel, is set to be higher than the Gnd. In other words, the voltage range of the data signal X-j is set to be within the power source voltage.

A control circuit 12 supplies a clock signal (not shown) to each of the Y driver 14 and the X driver 16 to control both of them, and supplies to the X driver 16 an image date defining a gray level for each pixel.

Figure 2:
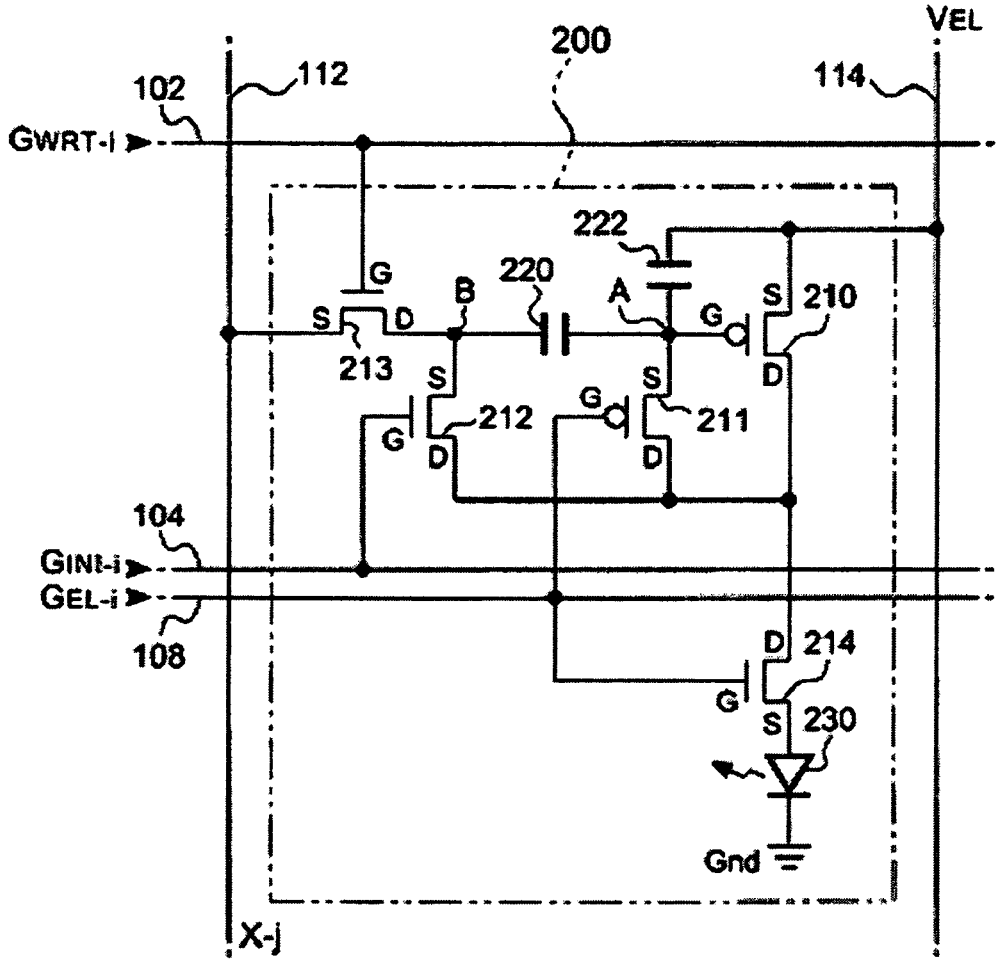
FIG. 2 is a diagram illustrating a configuration of a pixel circuit in an electro-optical device.

In this embodiment, the pixel circuit 200 arranged in a matrix shape is common to all. Therefore, the configuration of the pixel circuit 200 will be described assuming that it is located at the i-th row and the j-th column. FIG. 2 is a diagram representing the configuration of the pixel circuit 200 located at the i-th row and the j-th column.

As shown in this diagram, the pixel circuit 200 includes a driving transistor 210, transistors 211, 212, 213 and 214 serving as first to fourth switching elements, a capacitor 220 serving as a capacitive element, and an OLED element 230 which is an electro-optical element.

A source of the p-channel type driving transistor 210 is connected to a power line 114. Further, a drain of the driving transistor 210 is connected to the drain of a p-channel type transistor 211 and each drain of n-channel type transistors 212 and 214, respectively.

A source of the transistor 214 is connected to an anode of the OLED element 230 and the cathode of the OLED element 230 is grounded to the low potential voltage Gnd of the power source. For this reason, the OLED element 230 is configured to be electrically connected between the high potential voltage $V_{EL}$ and the low potential voltage Gnd of the power source, together with the driving transistor 210 and the transistor 214.

On the other hand, a gate of the driving transistor 210 is connected to one end of the capacitor 220 and the source of the transistor 211. In addition, for the sake of explanation, the gate (one end of the capacitor 220) of the driving transistor 210 is denoted by node A.

Further, one end of capacitor 222 is connected to the node A, and the other end of the capacitor 222 is connected to the power line 114. Also, since the gate capacitor of the driving transistor 210 can be substituted for the capacitor 222, it may not be necessary to provide the capacitor 222.

The gates of the transistors 211 and 214 are commonly connected to the control line 108 of i-th row. For this reason, the transistors 211 and 214 each having a different channel type are turned on or off exclusively to each other in response to logical level of the control signal $G_{EL-i}$ supplied to the control line 108.

The source of the transistor 212 is connected to each of the other end of the capacitor 220 and the drain of the n-channel type transistor 213, while the gate of the transistor 212 is connected to the control line 104 in i-th row. For this reason, the transistor 212 is turned on when the control signal $G_{INI-i}$ supplied to the control line 104 is H level and turned off when it is L level.

Further, the source of the transistor 213 is connected to the data line 112 of j-th column and the gate is connected to the scan line 102 of i-th row. For this reason, the transistor 213 is turned on when the scan signal $G_{WRT-i}$ is H level, and applies the data signal X-j supplied to the data line 112 of the j-th column to the other end of the capacitor 220. Herein, for the sake of explanation, the other ends of the capacitor 220 (the source of the transistor 212, the drain of the transistor 213) are denoted by node B.

In addition, the pixel circuit 200 arranged in a matrix shape is formed on a transparent substrate such as glass, together with the scan line 102 or the data line 112, and the control lines 104 and 108. For this reason, the driving transistor 210 or the transistors 211, 212, 213 and 214 are composed of a TFT (thin film transistor) by poly silicon process. Further, the OLED element 230, on the substrate, has a transparent electrode film such as ITO (Indium Tin Oxide) as an anode (separate electrode), and a single metal film such as aluminum or lithium or a deposited film thereof as a cathode (common electrode) to form a light-emitting layer.

Figure 3:
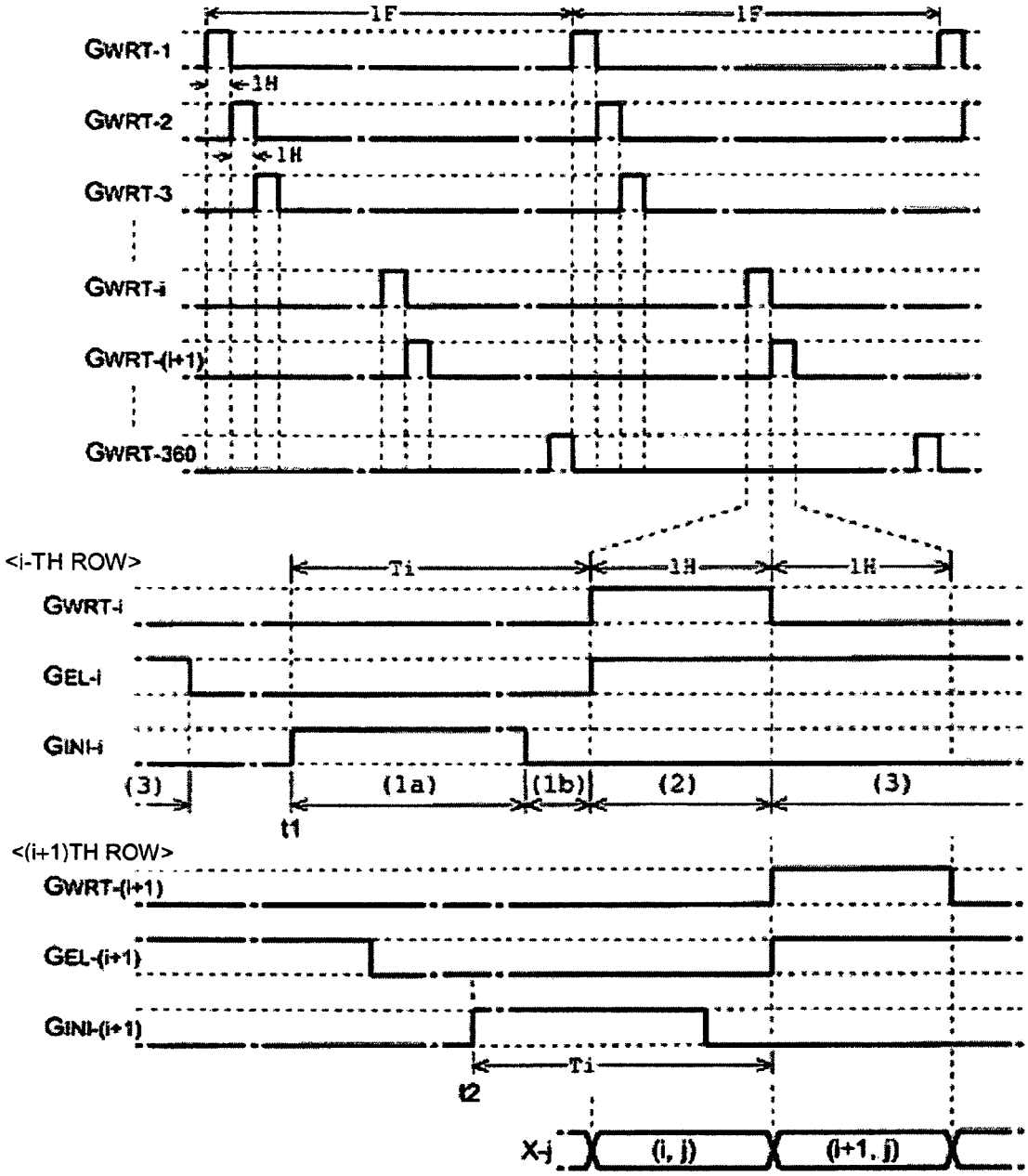
FIG. 3 is a timing chart illustrating an operation of an electro-optical device.

Next, an operation of an electro-optical device 10 will be described. FIG. 3 is a timing chart for describing the operation of the electro-optical device 10.

First of all, the Y driver 14, as shown in FIG. 3, selects the scan line 102 of first, second, third, . . . , 360-th row from starting time point of one vertical scan period 1F, in an orderly manner for each horizontal scan period 1H, and make only the scan signal of the selected scan line 102H level, but make the other scan signals L level.

Here, with respect to one horizontal scan period 1H when the scan line 102 of i-th row is selected and the scan signal $G_{WRT-i}$ is H level, the horizontal scan period and the operation before and after the horizontal scan period will be described with reference to FIGS. 4 to 7 together with FIG. 3.

As shown in FIG. 3, the preparation of writing operation of the pixel circuit 200 at the i-th row and the j-th column starts from a timing t1 preceding, by a period Ti, a timing when the scan signal $G_{WRT-i}$ becomes H level. On the other hand, even though the scan signal $G_{WRT-i}$ is changed from H level to L level, the operation of maintaining light emitting based on the applied voltage is continued.

Therefore, in relation to the operation of the pixel circuit 200 at the i-th row and j-th column, when generally divided, it can be divided into a first period (1) until the scan signal $G_{WRT-i}$ becomes H level from the timing t1, a second period (2) while the scan signal $G_{WRT-i}$ is H level, and a third period after the scan signal $G_{WRT-i}$ is changed to L level.

These first to third periods are named as an initializing period (1), a writing period (2) and a light-emitting maintaining period (3) according to each operation. Among them, the initializing period (1) can be further divided into two periods (1*a*) and (1*b*) in this embodiment.

Hereinafter, the operations of these periods will be described.

Figure 4:
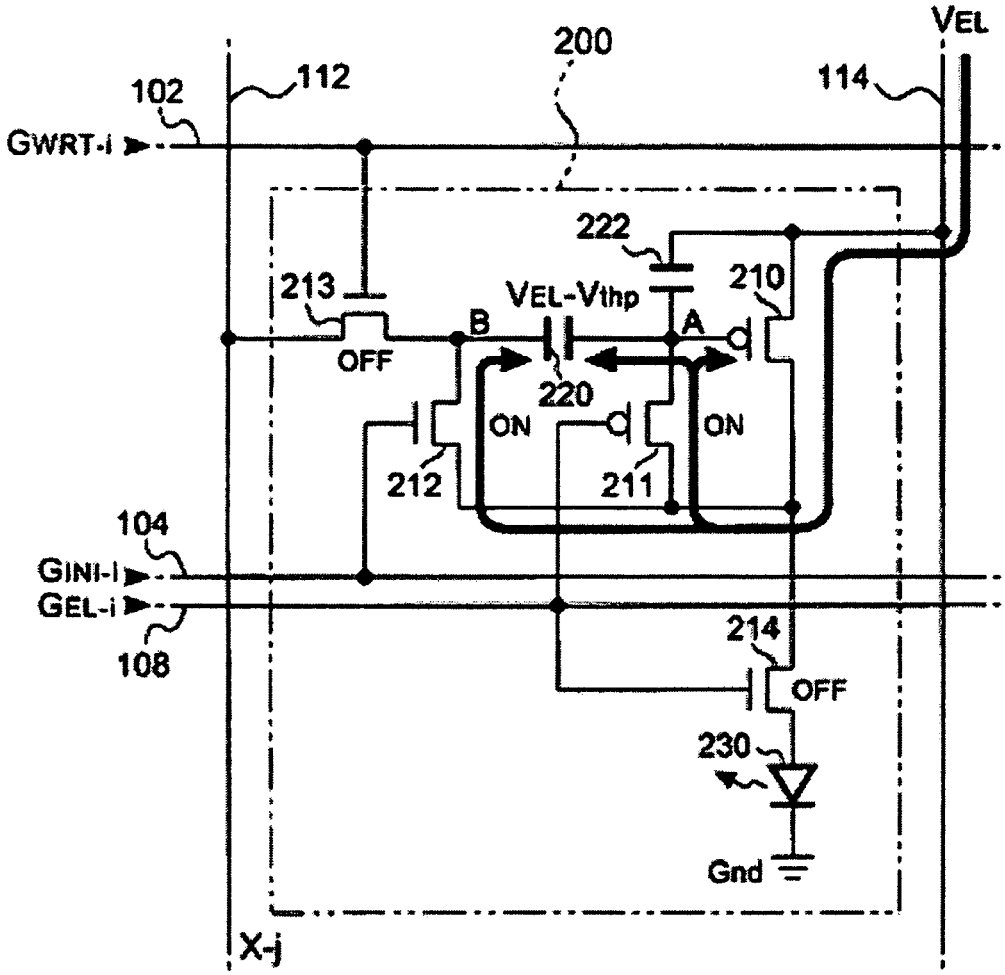
FIG. 4 is an explanatory operation diagram of a pixel circuit.

First of all, before the timing t1, the scan signal $G_{WRT-i}$ and the control signal $G_{EL-i}$, $G_{INI-i}$ are all L level. And, at timing t1, in the first period (1*a*) of the initializing period (1), the Y driver 14 makes only the control signal $G_{INI-I}$ H level. For this reason, as shown in FIG. 4, the pixel circuit 200 the transistor 211 is turned on by the control signal $G_{EL-i}$ of L level, so that the driving transistor 210 acts as a diode. Accordingly, the node A becomes a voltage ($V_{EL}-V_{thp}$), which is made by subtracting a threshold voltage $V_{thp}$ of the driving transistor 210 from the power source voltage $V_{EL}$. Further, since the transistor 212 is also turned on, the node B becomes the same potential as the node A, and thus the charge accumulation state of the capacitor 220 is made clear.

The drain of the driving transistor 210 is connected to each of the drain of the p-channel type transistor 211 and the drains of the n-channel type transistors 212 and 214, so that two electrodes of the capacitor 220 can be the same potential, thus the charge accumulation state of the capacitor 220 can also be cleared.

Here, in the period (1*a*), the driving transistor 210 acts as a diode by turning on the transistor 211, however, because the gate voltage of the p-channel type driving transistor 210 is close to the power source voltage $V_{EL}$, the current between the source and the drain is in a difficult state to flow. For this reason, until the node A reaches the voltage ($V_{EL}-V_{thp}$), in fact, a relatively long time is required. However, in this embodiment, in the period (1*a*), the transistors 211 and 212 are turned on together and both ends of the capacitor 220 are in a short-circuit state, so that it is not necessary to consider a time loss by charging and discharging of the capacitor 220. Further, the period (1*a*) is not related to the writing period (2), and thus a period required for the period (1*a*), i.e., a time until the node A reaches the voltage ($V_{EL}-V_{thp}$), can be sufficiently secured for a period preceding the writing period (2).

As described above, the X driver 16 outputs the data signal so that the pixel can be dark as the voltage is high, but in relation to the voltage of the data signal and the voltage ($V_{EL}-V_{thp}$) at node A in a final timing of the period (1*a*), the highest voltage of the data signal designating the lowest gray level (black color) of the pixel is below the voltage ($V_{EL}-V_{thp}$).

Accordingly, as the pixel is designated to become lighter gradually, the data signal is changed in a decreasing direction for the voltage ($V_{EL}-V_{thp}$).

Figure 5:
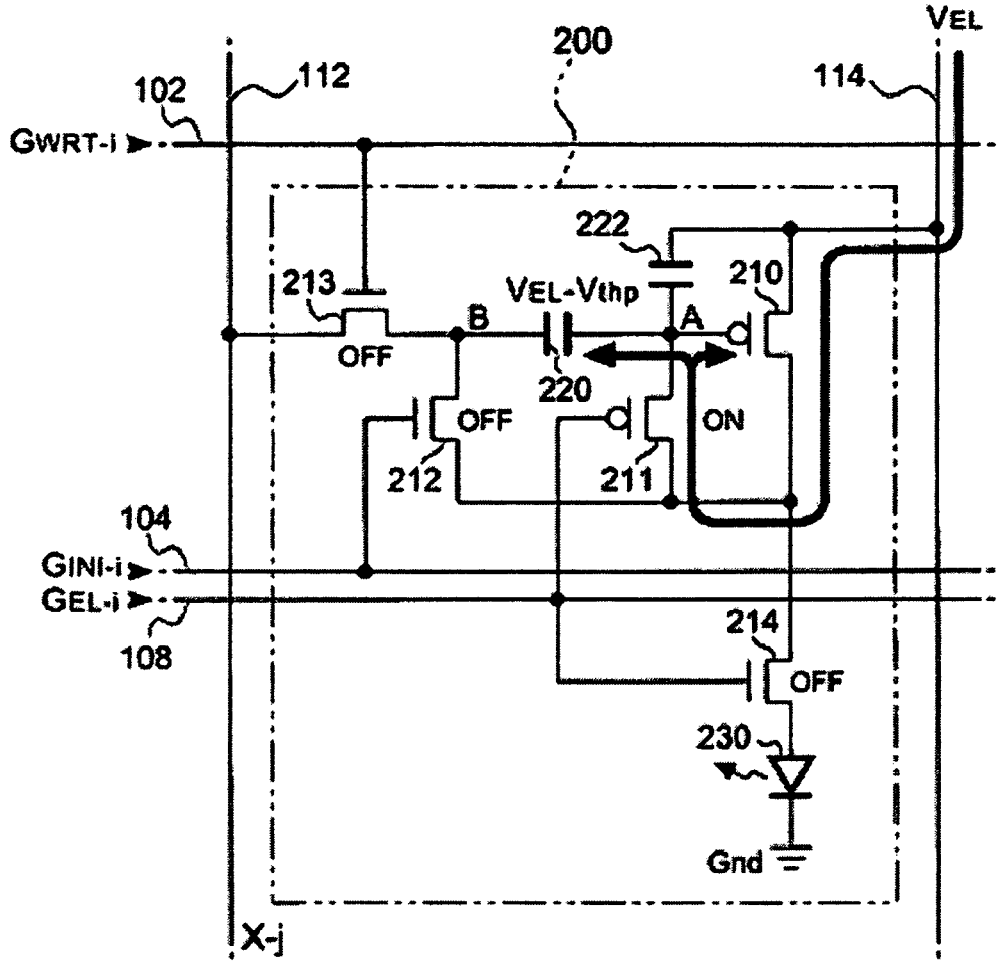
FIG. 5 is an explanatory operation diagram of a pixel circuit.

Next, when Y driver 14 reaches a start timing of period (1*b*) in the initializing period (1), it makes the control signal $G_{INI-i}$ return to L level. For this reason, as shown in FIG. 5, the transistor 212 is turned off in the pixel circuit 200, but the driving transistor 210 still acts as a diode by having the transistor 211 continuously turned on.

Subsequently, at the start timing in the writing period (2), the Y driver 14 have the control signal $G_{EL-i}$ return to H level, so that the node A has the voltage ($V_{EL}-V_{thp}$) in the start timing. However, since the node A is maintained only by the capacitor 222, as the voltage at the node B is changed, the voltage at the node A is also changed.

Figure 6:
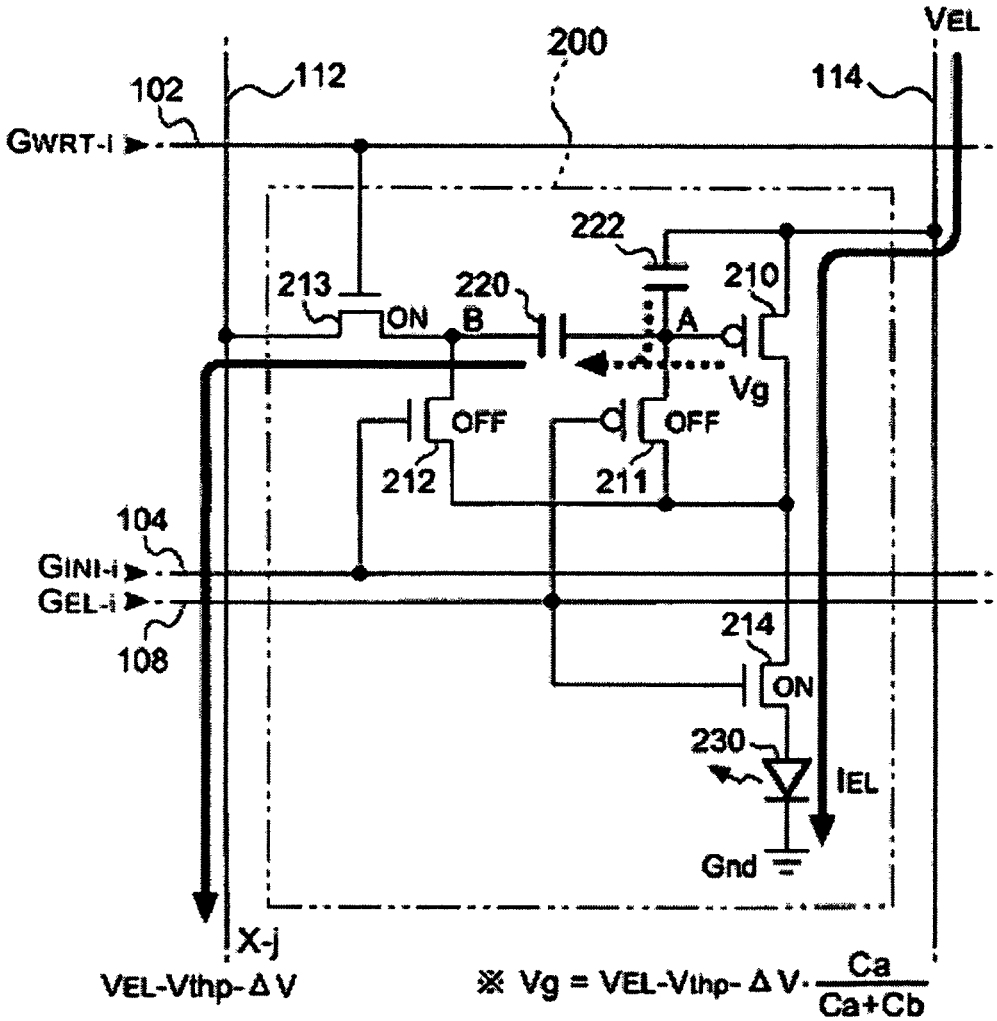
FIG. 6 is an explanatory operation diagram of a pixel circuit.

During the writing period (2), the Y driver 14 make the scan signal $G_{WRT-I}$ H level. Accordingly, as shown in FIG. 6, the transistor 213 is turned on. On the other hand, the X driver 16 supplies the data signal X-j of the gray level voltage corresponding to the gray level of the pixel at the i-th row and j-th column, so that the node B is changed to a gray level voltage from the voltage ($V_{EL}-V_{thp}$) in the initializing period (1).

As described above, since the highest voltage of the data signal is below the voltage ($V_{EL}-V_{thp}$), the voltage of the data signal X-j can be designated as ($V_{EL}-V_{thp}-\Delta V$). Further, $\Delta V$ represents voltage changing (decreased) portion from the voltage ($V_{EL}-V_{thp}$) at the node B in the initializing period (1), and $\Delta V$ becomes higher as the pixel is brightened.

In this way, the node B decreases from the voltage ($V_{EL}-V_{thp}$) to the voltage ($V_{EL}-V_{thp}-\Delta V$) of the data signal X-j during a period from the initializing period (1) to the writing period (2). Accordingly, the node A decreases from the voltage ($V_{EL}-V_{thp}$) in the initializing period (1) as much as a resulting value obtained by dividing the voltage changing portion $\Delta V$ by a capacity ratio between the capacitor 220 and the gate capacitance of the driving transistor 210.

More specifically, when the size of the capacitor 220 is Ca and the gate capacitance of the driving transistor 210 is Cb, the node A only decrease from the voltage ($V_{EL}-V_{thp}$) by $\{\Delta V \cdot Ca/(Ca+Cb)\}$. As a result, the voltage Vg at the node A can be expressed as follows.

$$Vg=V_{EL}-V_{thp}-\Delta V \cdot Ca/(Ca+Cb) \quad \text{(a)}$$

Further, during the writing period (2), when the control signal $G_{EL-i}$ becomes H level, the transistor 214 is turned on. Accordingly, as shown in FIG. 6, the current $I_{EL}$ corresponding to the voltage Vg at the node A flows through a path of the power line 114→the driving transistor 210→the transistor 214→the OLED element 230→the ground Gnd. For this reason, the OLED element 230 starts to emit light with brightness in response to the corresponding current.

Figure 7:
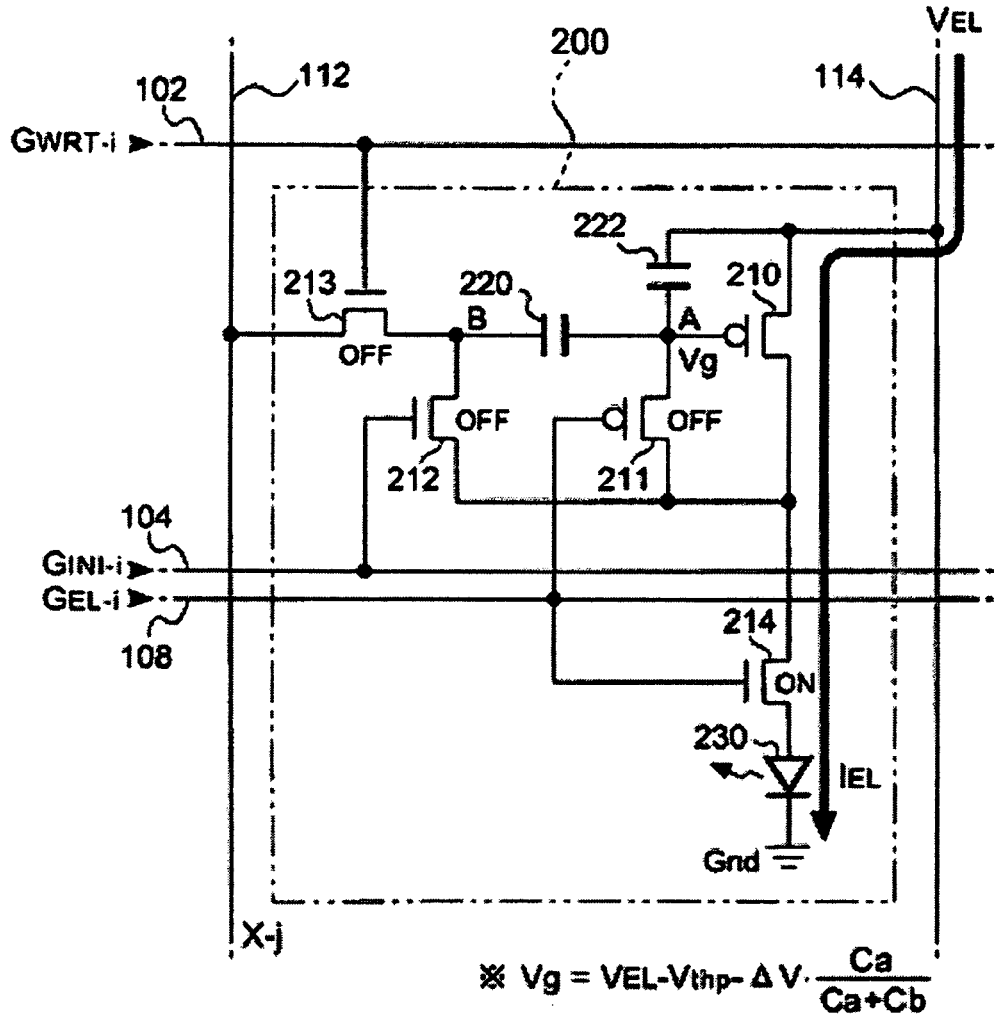
FIG. 7 is an explanatory operation diagram of a pixel circuit.

And, when reaching the light-emitting maintaining period (3), the Y driver 14 make the scan signal $G_{WRT-i}$ L level, while maintaining the control signal $G_{EL-i}$ in H level. For this reason, in the pixel circuit 200, as shown in FIG. 7, the transistor 213 is off. However, since the voltage maintaining state in the capacitor 220 is not changed, the node A is maintained as the voltage Vg. Due to this, during the light-emitting maintaining period (3), the OLED element 230 continues to emit light with brightness corresponding to the current $I_{EL}$.

During the writing period (2) and the light-emitting maintaining period (3), the current $I_{EL}$ flowing through the OLED element 230 is determined by the conducting state between the source and the drain of the driving transistor 210, and the conducting state is set to be the voltage at the node A. Here, the voltage of the gate seen from the source of the driving transistor 210 is the voltage Vg at the node A, so that the current $I_{EL}$ is shown as follows.

$$I_{EL}=(\beta/2)(V_{EL}-Vg-V_{thp})^2 \quad \text{(b)}$$

In addition, $\beta$ in the formula is a gain coefficient of the driving transistor 210.

Here, if formula (a) is applied to formula (b), it becomes as follows:

$$I_{EL}=(\beta/2)\{\Delta V \cdot Ca/(Ca+Cb)\}^2 \quad \text{(c)}$$

As shown in formula (c), the current $I_{EL}$ flowing through the OLED element 230 is determined only by the voltage changing portion ΔV without depending on the threshold $V_{thp}$ of the driving transistor 210 (the capacitor Ca, Cb and the gain coefficient β are fixed values).

If the light-emitting maintaining period 3 continues only for a predefined period, the Y driver 14 makes the control signal $G_{EL-i}$ L level. By this, the transistor 214 is turned off, so that the current path is cut off to make the OLED element 230 turn off.

Here, the Y driver 14 controls such that H level periods of the control signals $G_{EL-i}$ to $G_{EL-360}$ from the first row to the $360^{th}$ row are the same. In other words, for all OLED elements 230, the ratio of the light-emitting maintaining period in one vertical scan period is controlled so as to be constant. For this reason, it is possible to make the whole screen bright if the light-emitting maintaining period (3) is long, and to make the whole screen dark if it is short.

In addition, the longest period of the light-emitting period (3) is the entire period exclusive of the initializing period (1) and the writing period (2) among one vertical scan period (1F). For this reason, with respect to i-th row, the control signal $G_{EL-i}$ can be H level for the period from the timing when the scan signal $G_{WRT-i}$ is changed from H level to L level to the timing t1 preceding, by the period Ti, the timing when the scan line 102 of the i-th row is selected.

Here, the operation of the pixel circuit 200 at the i-th row and the j-th column has been described, but for the other pixels in the i-th row, the operation in the initializing period (1), the writing period (2) and the light-emitting maintaining period (3) are conducted in parallel simultaneously.

Moreover, the above explanations have been focused on i-th row, but for the first to the $360^{th}$ row, the scan line 102 is selected in turn for every one horizontal scan period 1H and the operation of the writing period (2) is carried out for the selection period. And, before the writing period, the initializing period (1) is carried out and the light-emitting maintaining period (3) is carried out after the writing period (2). For example, in relation to the (i+1)-th row following the i-th row, as shown in FIG. 3, the initializing period (1) starts from the timing t2 preceding, by the period Ti, the timing when the scan signal $G_{WRT-(I+1)}$ becomes H level. Then, the writing period (2) is the period where the scan signal $G_{WRT-(I+1)}$ is H level. During the writing period of the (i+1)-th, the data signal X-j of the voltage corresponding to the gray level of the pixel at the (i+1)-th row and the j-th column is supplied to the data line 112 at the j-th column, the changing portion of the voltage is input to the node A, and then the light-emitting maintaining period (3) starts.

Accordingly, the initializing period (1) can be carried out for more than two adjacent rows. Similarly, the light-emitting maintaining period (3) is carried out in more than two adjacent rows.

According to the first embodiment, during the initializing period (1), the driving transistor 210 is diode-connected by turning on the transistor 211, and the voltage maintaining state of the capacitor 220 is cleared by turning on transistor 212. Then, by turning off the transistor 212 and the transistor 211, the node A becomes the voltage ($V_{EL}-V_{thp}$) corresponding to the threshold $V_{thp}$ of the driving transistor 210. Herein, although it take a relatively long time for the node A to reach the voltage ($V_{EL}-V_{thp}$), in accordance with the embodiment, the initializing period (1) is allotted by securing a sufficiently long period in the period preceding, by several periods from a point of view of time, the writing period (2), so that there is no problem in the long initializing period (1).

Further, in the first embodiment, during the writing period 2, the data signal X-j is applied to the node B to change the voltage of the other end of the capacitor 220. By redistribution of charge caused by the voltage change, the voltage corresponding to the current that is to flow into the OLED element 230 is applied to the gate of the driving transistor 210. For this reason, in addition to securing the initializing period (1), it is possible to shorten the time required for applying a voltage to the gate of the driving transistor 210, compared to the method in that the voltage corresponding to the current to flow into the OLED element 230 is directly applied.

In addition, during the light-emitting maintaining period (3), the current flowing through the OLED element 230 does not depend on the threshold voltage $V_{thp}$ of the driving transistor 210. For this reason, even though the threshold voltage $V_{thp}$ of the driving transistor 210 is deviated for every pixel circuit 200, the current flowing through the OLED element 230 can be uniformly maintained.

Therefore, in the electro-optical device according to the first embodiment, it is possible to make the writing time of data signal short even though the number of pixels increases as resolution is high, and to secure uniformity of the current flowing through OLED element 230.

Second Embodiment

Next, an electro-optical device according to a second embodiment of the present invention will be described. The electro-optical device according to the second embodiment has a pixel circuit 200 in FIG. 8 substituted for the pixel circuit in the first embodiment.

Figure 8:
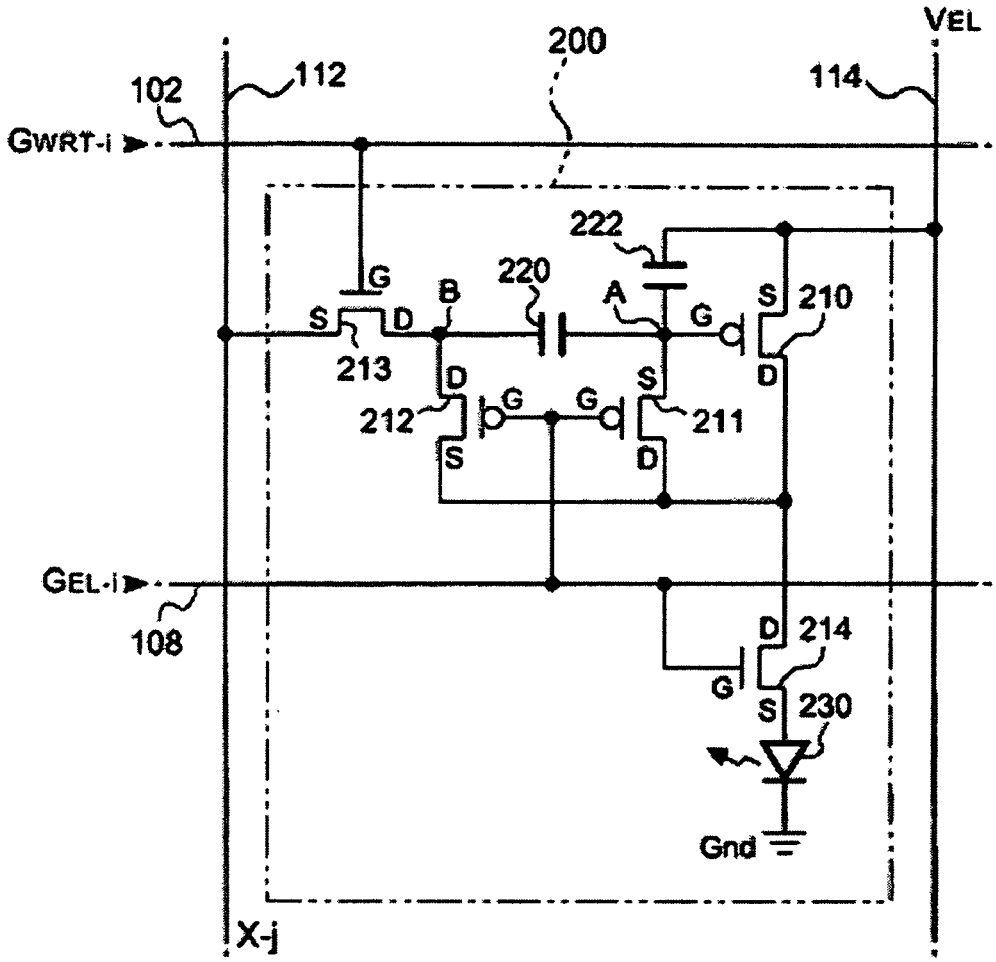
FIG. 8 is a diagram illustrating a configuration of a pixel circuit in an electro-optical device according to a second embodiment.

The pixel circuit (in the first embodiment) in FIG. 2 has a configuration in which on and off of the transistors 211 and 214 are commonly controlled by the control signal $G_{EL-i}$ supplied by the control line 108 and on and off of the transistor 212 are controlled by the control signal $G_{INI-i}$ supplied by the other control line 104, however, the pixel circuit 200 shown in FIG. 8 has a configuration in which the transistor 212 is changed to a p-channel type, and the gate of the transistor 212 is connected to the control line 108 so as to commonly control not only the transistors 211 and 214 but the transistor 212. For this reason, the control line 104 in FIGS. 1 and 2 is not required in the second embodiment.

In addition, in FIG. 8, since the transistors 211 and 212 are all p-channel type, the transistor 214 is n-channel type, if the control signal $G_{EL-i}$ is H level, the transistors 211, 212 are all turned off and the transistor 214 is turned on, but, if the control signal $G_{EL-i}$ is L level, the transistors 211, 212 are all turned on and the transistor 214 is turned off. In other words, the transistors 211, 212 and the transistor 214 are different in conduction type, so that they are exclusively turned on and off.

Here, if the transistors 211, 212 are the same channel type, the threshold voltage of the transistors 211, 212 is the same. Accordingly, the operation can be reliably controlled by the same control signal $G_{INI-i}$ compared to the case in that they are different channel type each other. For example, it is possible to prevent malfunction in which the same control signal $G_{INI-i}$ makes one transistor on and the other transistor off. Further, by making them have the same channel type, it is not necessary to provide a margin when injecting impurities into the transistor, and the transistor 211 and the transistor 212 can be more closely arranged. Accordingly, the transistor occupying area in the pixel area can be minimized, and it is possible to manufacture the transistor 211 and the transistor 212 without deviation in their characteristics. Moreover, if the driving transistor 210 is the same channel type as the transistor 211 and the transistor 212, the same effect can be obtained. Also, by a configuration having only the same channel type, the voltage range in the power source with respect to the signal supplied to the pixel circuit can be minimized, so that it is possible to implement an electronic circuit with high reliability.

Figure 9:
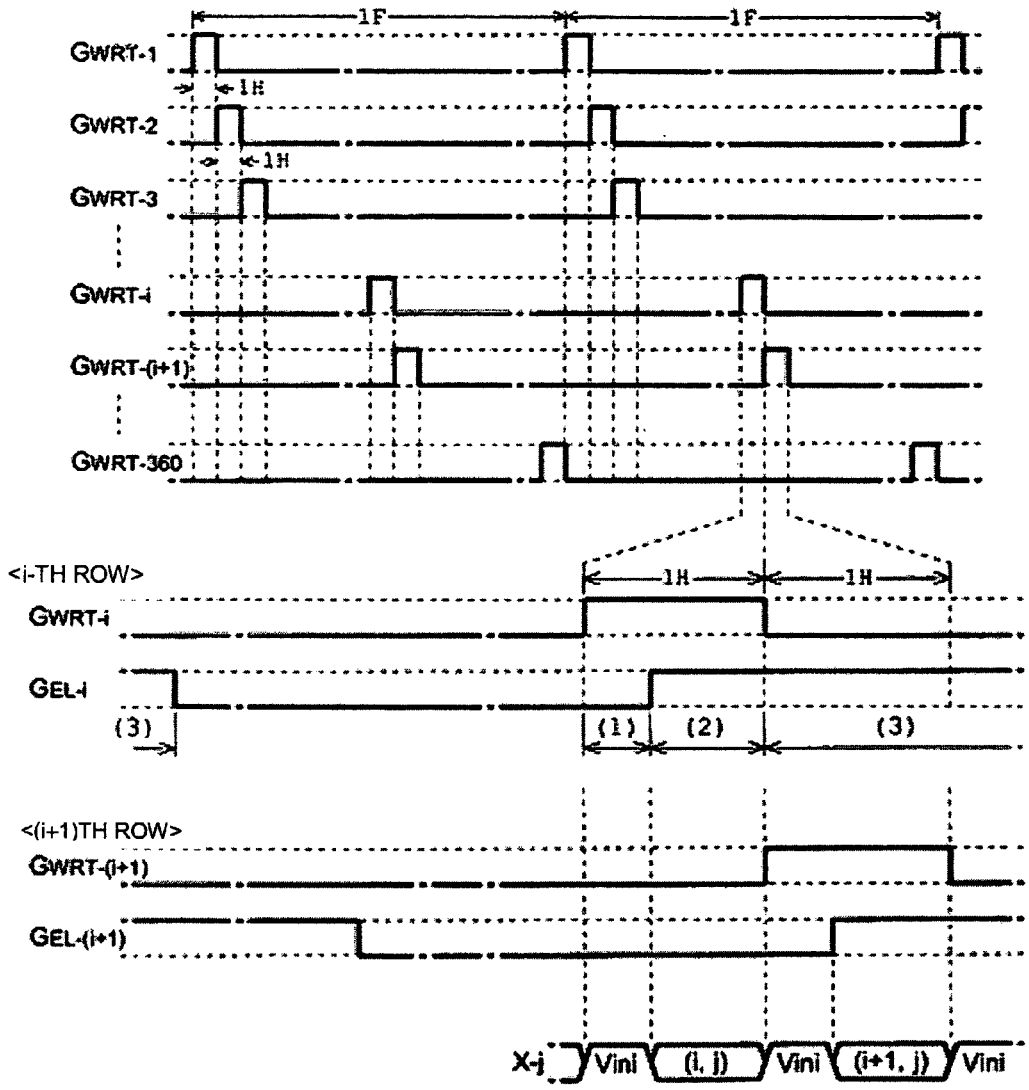
FIG. 9 is a timing chart illustrating an operation of an electro-optical device.

Next, the operation of the second embodiment will be described. FIG. 9 is a timing chart for describing the operation of electro-optical device according to the second embodiment.

First, as shown in FIG. 9, the Y driver 14 selects the scan line 102 of the first row, the second row, the third row, . . . , $360^{th}$ in turn from the start of one vertical scan period (1F) one by one for each one horizontal scan period (1H), and makes only the scan signal in the selected scan line 102H level and the scan signals in the other scan lines L level.

Figure 10:
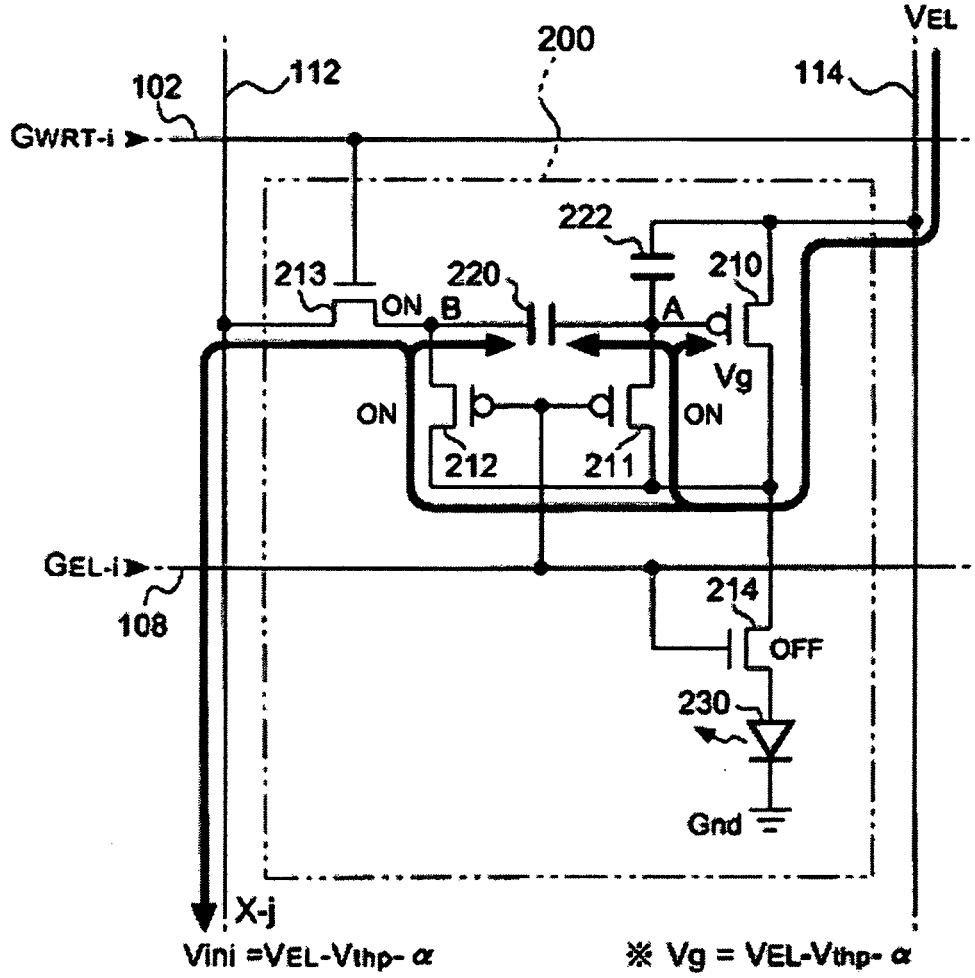
FIG. 10 is an explanatory operation diagram of a pixel circuit.

Herein, with respect to one horizontal scan period 1H when the scan line 102 of i-th row is selected and thus the scan signal $G_{WRT-i}$ is H level, the corresponding horizontal scan period and the operation before and after the period will be described with reference to FIGS. 10 to 12 together with FIG. 9.

As shown in FIG. 9, the one horizontal scan line 1H where the scan signal $G_{WRT-i}$ is H level can be generally divided into an initializing period (1) where the control signal $G_{EL-i}$ is L level and a writing period (2) where the control signal $G_{EL-i}$ is H level.

In the second embodiment, before the initializing period (1) of i-th row, the scan signal $G_{WRT-i}$ and the control signal $G_{EL-i}$ are both L level. Then, when reaching the initializing period (1), the Y driver 14 makes the control signal $G_{EL-i}$ H level while maintaining the control signal $G_{EL-i}$ in H level. Also, the X driver 16 makes the data signal supplied to all the data lines 112 the initial voltage $V_{ini}$.

Before the initializing period (1), the control signal $G_{EL-i}$ is L level, so that the transistor 214 is turned off, but the transistor 211 and 212 are all turned on. Also, the scan signal $G_{WRT-i}$ is H level, so that the transistor 213 is also turned on. Accordingly, in the pixel circuit 200, if the following condition is satisfied, as shown in FIG. 10, the current flows through a path of the power line 114→the driving transistor 210→the transistor 212→the transistor 213→the data line 112. Here, the condition for the current to flow through the path is that the initial voltage $V_{ini}$ in the data line 112 is lower than the voltage ($V_{EL}-V_{thp}$) which has come out by subtracting the threshold voltage $V_{thp}$ of the driving transistor 210 from the voltage $V_{EL}$ of the power line 114. For this reason, the initial voltage $V_{ini}$ can be expressed as ($V_{EL}-V_{thp}-\alpha$). Here, it is better if $\alpha$ is a positive value, but in this embodiment, it is substantially close to zero. Further, the initial voltage $V_{ini}$ and the data signal have a relationship in that the highest voltage value of the data signal designating the lowest gray level (black color) of the pixel is below the initial voltage ($V_{EL}-V_{thp}-\alpha$). For this reason, in the second embodiment, as the pixel is brighter gradually, the data signal moves in a decreasing direction in relation to the voltage ($V_{EL}-V_{thp}$).

In this way, during the initializing period (1), the voltage difference is small, but the current flows from the power line 114 to the data line 112. Further, during the initializing period (1), the transistor 211 and 212 are all turned on, so that both ends of the capacitor 220 become a short-circuit state. For this reason, the loss caused by the charge and discharge of the capacitor 220 does not occur, and accordingly the node A becomes substantially the same initial voltage ($V_{EL}-V_{thp}-\alpha$) as the data line 112 within a relatively short time period.

Subsequently, at the start timing of the writing period (2), the Y driver 14 maintains the scan signal $G_{WRT-i}$ in H level, and then changes the control signal $G_{EL-i}$ to H level. For this reason, at the start timing, the node A has the voltage ($V_{EL}-V_{thp}-\alpha$). However, the node A is only maintained by the capacitor 222, so that in the same way as in the first embodiment, if the node B is changed in voltage, then the node A is also changed in voltage.

On the other hand, during the writing period (2), the X driver 16 supplies the data signal X-j of the gray level voltage corresponding to the gray level of the pixel at the i-th row and j-th column to the data line 112 of the j-th column. For this reason, the node B decreases from the voltage ($V_{EL}-V_{thp}-\alpha$) of the initializing period (1) to the gray voltage, so that the voltage of the data signal X-j can be expressed as ($V_{EL}-V_{thp}-\alpha-\Delta V$).

Figure 11:
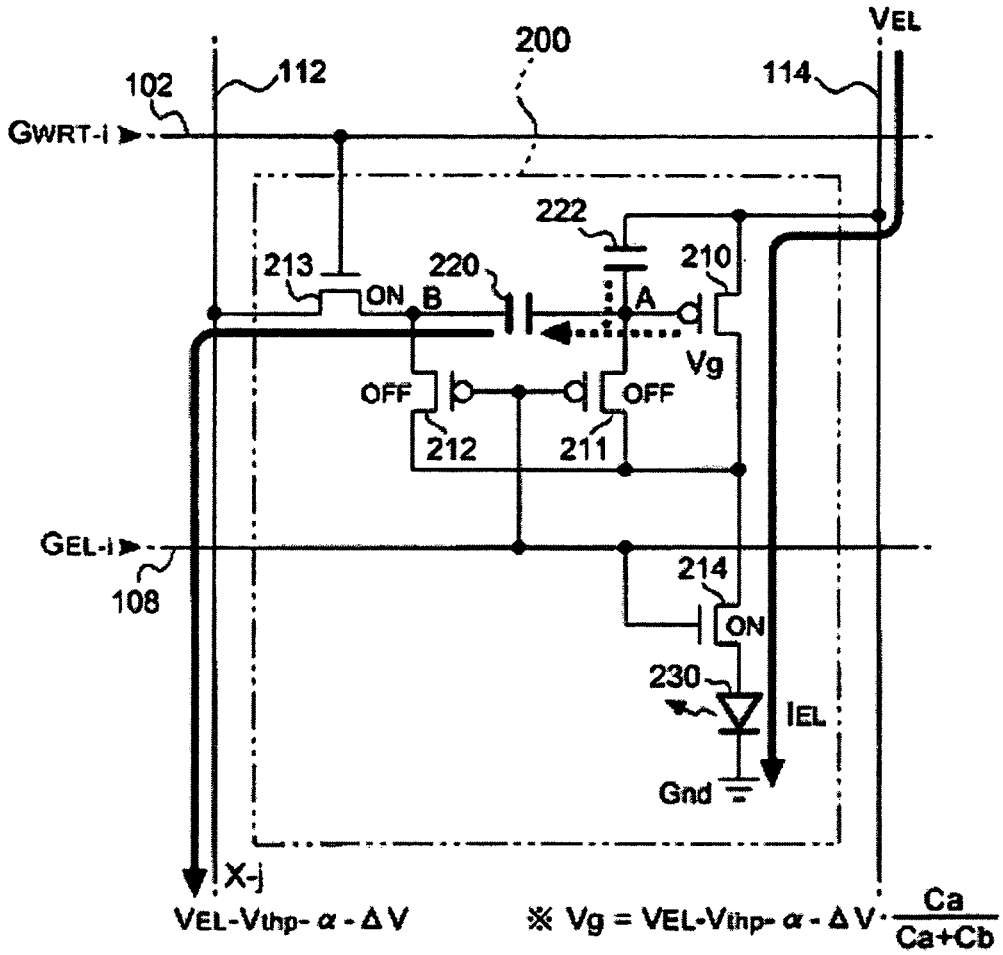
FIG. 11 is an explanatory operation diagram of a pixel circuit.
Figure 12:
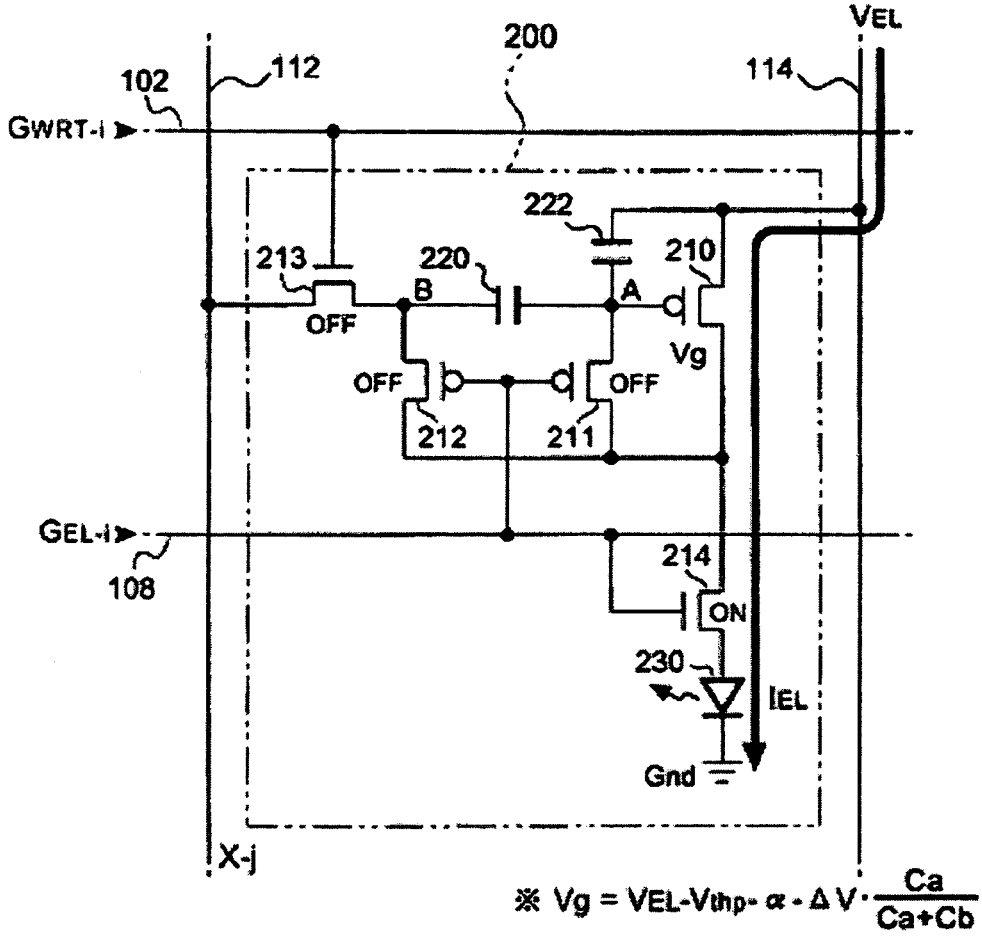
FIG. 12 is an explanatory operation diagram of a pixel circuit.

Therefore, as shown in FIG. 11, the node A decreases from the voltage ($V_{EL}-V_{thp}-\alpha$) in the initializing period (1) as much as a resulting value obtained by dividing the voltage changing portion $\Delta V$ at node B by a capacity ratio between the capacitor 220 and the gate capacitance of the driving transistor 210.

Further, during the writing period (2), when the control signal $G_{EL-i}$ is in H level, the transistor 214 is turned on, and thus, as shown in FIG. 11, the current $I_{EL}$ corresponding to the voltage Vg at the node A flows through a path of the power line 114→the driving transistor 210→the transistor 214→the OLED element 230→the ground Gnd. Accordingly, the OLED element 230 starts to emit light with brightness corresponding to the corresponding current.

And, when reaching the light-emitting maintaining period (3), the Y driver 14 make the scan signal $G_{WRT-i}$ L level, while maintaining the control signal $G_{EL-i}$ in H level. For this reason, in the pixel circuit 200, as shown in FIG. 12, the transistor 213 is off, however, because the voltage maintaining state in the capacitor 220 is not changed, the node A is maintained in the voltage Vg. Thereby, in the light-emitting maintaining period (3), the OLED element 230 continues to emit light with brightness corresponding to the corresponding current $I_{EL}$.

In addition, in the second embodiment, differently from the first embodiment, the voltage at the node A when completing the initializing period is low as much as $\alpha$, and the $\alpha$ is remained in the formula (c) representing the current $I_{EL}$ flowing through the OLED element 230 during writing period (2) and the light-emitting maintaining period (3). However, there is no change in that it does not depend on the threshold $V_{thp}$ of the driving transistor 210. Originally, as described above, in the second embodiment, $\alpha$ is set to a positive value close to zero, so that the influence thereof can be ignored.

According to the second embodiment, differently from the first embodiment, the initializing period (1) of the i-th row is the whole period where the scan signal $G_{WRT-i}$ becomes H level, but the node A is maintained in the voltage ($V_{EL}-V_{thp}-\alpha$) by flowing the current in a state that both ends of the capacitor 220 is short-circuited, and accordingly it does not matter that the initializing period (1) is short. Also, even during the writing period (2), the writing is carried out during the second half of the period where the scan signal $G_{WRT-i}$ becomes H level, but the data line 112 is already in a state pre-charged to the initial voltage Vini close to the power voltage $V_{EL}$ during the initializing period (1). Accordingly, the data line 112 has been only changed from the initial voltage to the gray level voltage during the writing period (2), thereby, even though there is a parasitic capacity in the data line 112, only a short time is needed for the change. For this reason, in the second embodiment, it does not matter that the initializing period (1) and the writing period (2) are short.

Moreover, in the second embodiment, during the light-emitting maintaining period (3), the current flowing through the OLED element 230 does not depend on the threshold voltage $V_{thp}$ of the driving transistor 210, in the same manner as in the first embodiment.

Therefore, in the electro-optical device according to the second embodiment, it is possible to make the writing time of data signal short even though the number of pixels increases as resolution is high, and to secure uniformity of the current flowing through OLED element 230.

In addition, according to the second embodiment, compared to the first embodiment, the control line 104 is unnecessary, so that the line number per one row decreases. As a result, a yield of the product is improved, and in a case of a bottom-emission type, a bright display in which aperture ratio is increased is possible.

Third Embodiment

Next, an electro-optical device according to a third embodiment of the present invention will be described. The electro-optical device according to the third embodiment has a pixel circuit 200 in FIG. 13 substituted for the pixel circuit in the first embodiment.

Figure 13:
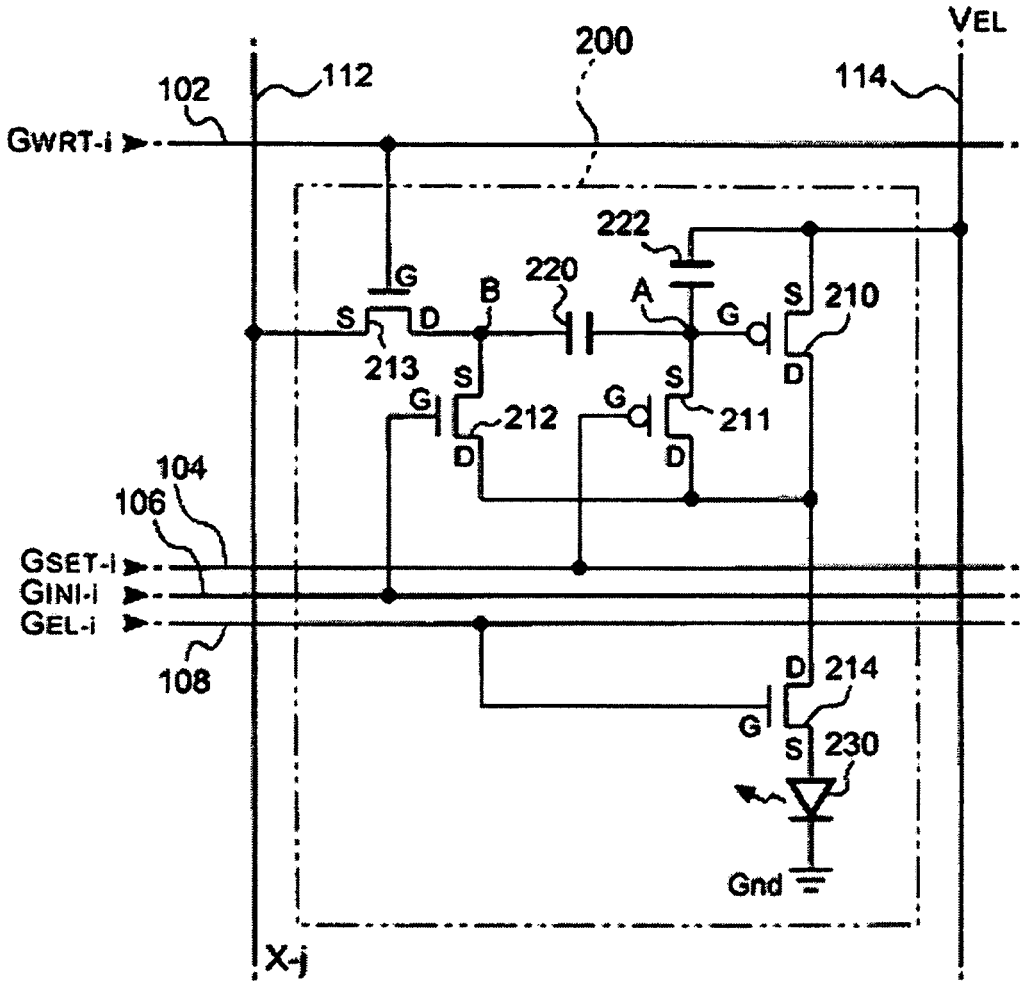
FIG. 13 is a diagram illustrating a configuration of a pixel circuit in an electro-optical device according to a third embodiment.

In FIG. 2 (the first embodiment), the gates of the transistors 211 and 212, and in FIG. 8 (the second embodiment), the gates of the transistors 211, 212 and 214 are each connected to the common control line, but in the pixel circuit 200 shown in FIG. 13, to the contrary, the gate of the transistors 211, 212 and 214 are each connected to another control lines 104, 106 and 108 to independently control on and off.

For this reason, in the third embodiment, among the control signals $G_{SET-i}$, $G_{INI-i}$ and $G_{EL-i}$ supplied to the control lines 104, 106 and 108, for example, the control signal $G_{SET-i}$ is made to be the same signal as the control signal $G_{INI-i}$ in FIG. 3 to make it operate as in the first embodiment, or the control signals $G_{SET-i}$, $G_{INI-i}$ are made to be the same signals as the $G_{EL-i}$ in FIG. 9 to make it operate as in the second embodiment. For this reason, according to the third embodiment, the degree of freedom in the circuit operation can be improved.

Figure 14:
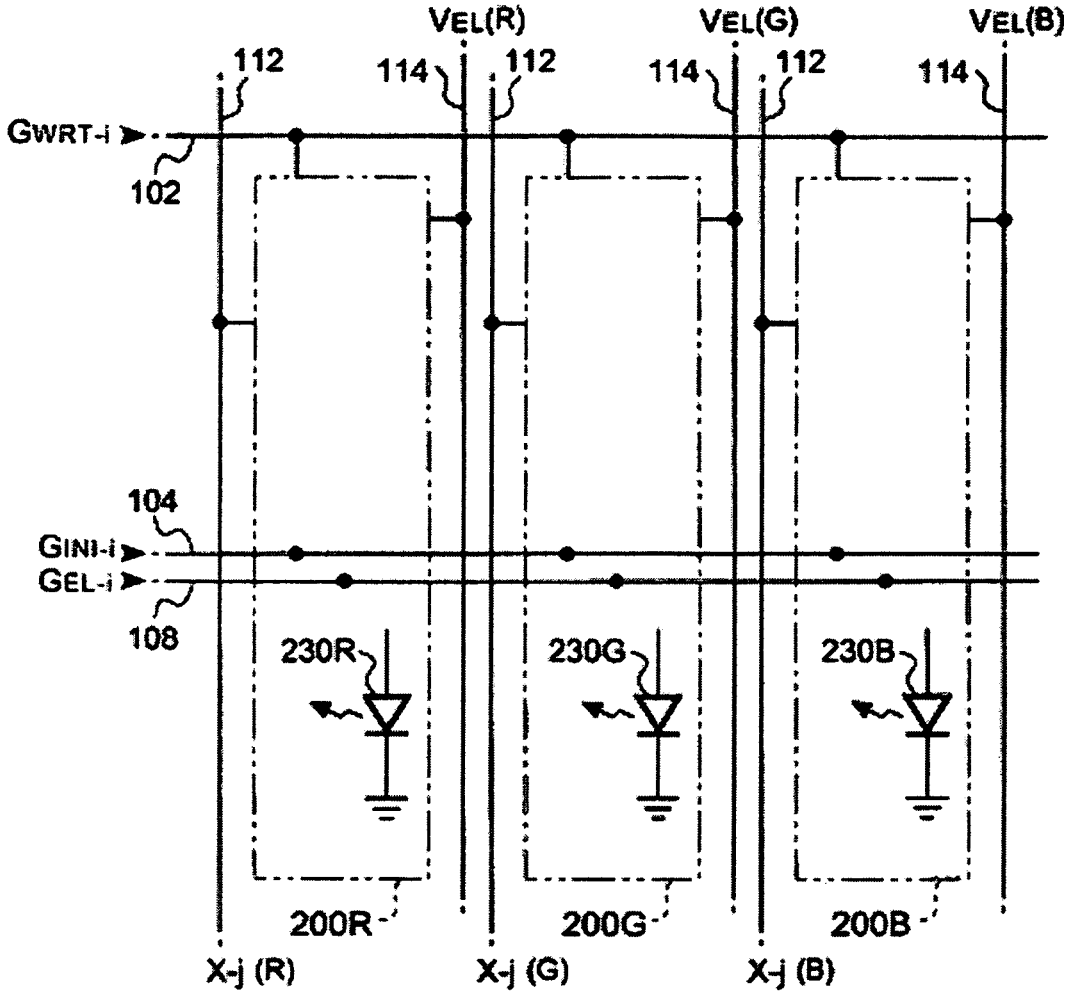
FIG. 14 is a diagram illustrating a configuration in which an electro-optical device according to the embodiments is colorized.

The present invention is not limited to the foregoing first to third embodiments and might have many variations. For example, each embodiment is configured to display gray level in relation to the pixel of single color, but as shown in FIG. 14, the pixel circuits 200R, 200G and 200B may be arranged to correspond to R red, G green and B blue, and then these three pixels constitute one dot to perform color display. And, when displaying a color, in the OLED elements 230R, 230G and 230B, the light-emitting layer is selected to emit light as red, green, and blue.

In such a configuration of displaying color, when the luminous efficiencies of the 230R, 230G and 230B are different from each other, the power voltage $V_{EL}$ needs to be different for each color.

However, as shown in FIG. 14, the scan line 102, the control lines 104 and 108 may be shared.

In addition, FIG. 14 is a diagram representing an embodiment when the first embodiment (see FIG. 2) is color display. A Color display using the second embodiment (see FIG. 8) and the third embodiment (see FIG. 13) is also possible.

In each embodiment, the driving transistor 210 is the p-channel type, but it can be also the n-channel type. Further, it is also applied to transistors 211, 212, 213 and 214. However, in a case of a configuration shown in FIG. 2, with respect to a channel type of the transistors 211 and 214, it is necessary to make one the p-channel type and the other the n-channel type, as described above. Also, in a case of a configuration shown in FIG. 8, it is necessary to make both transistors 211 and 212 one of n-channel or p-channel type, and the transistor 214 the other channel type.

Further, these transistors may be composed of a transmission gate in which p-channel type and n-channel type are complementarily coupled to restrain the voltage drop to the extent that it can be ignored.

Further, the OLED element 230 may be connected to the drain of the transistor 214 instead of being connected to the source of the transistor 214.

In addition, the OLED element 230 is one example of the current-driving type element. Instead of this, other light-emitting element such as an inorganic EL element, a field-emission (FE) element, LED, etc. may be used. Furthermore, an electrical linked element, an electro-chromic element, etc. may be used.

Next, an example will be described in which the electro-optical device according to the above-mentioned embodiments is used for an electronic apparatus.

Figure 15:
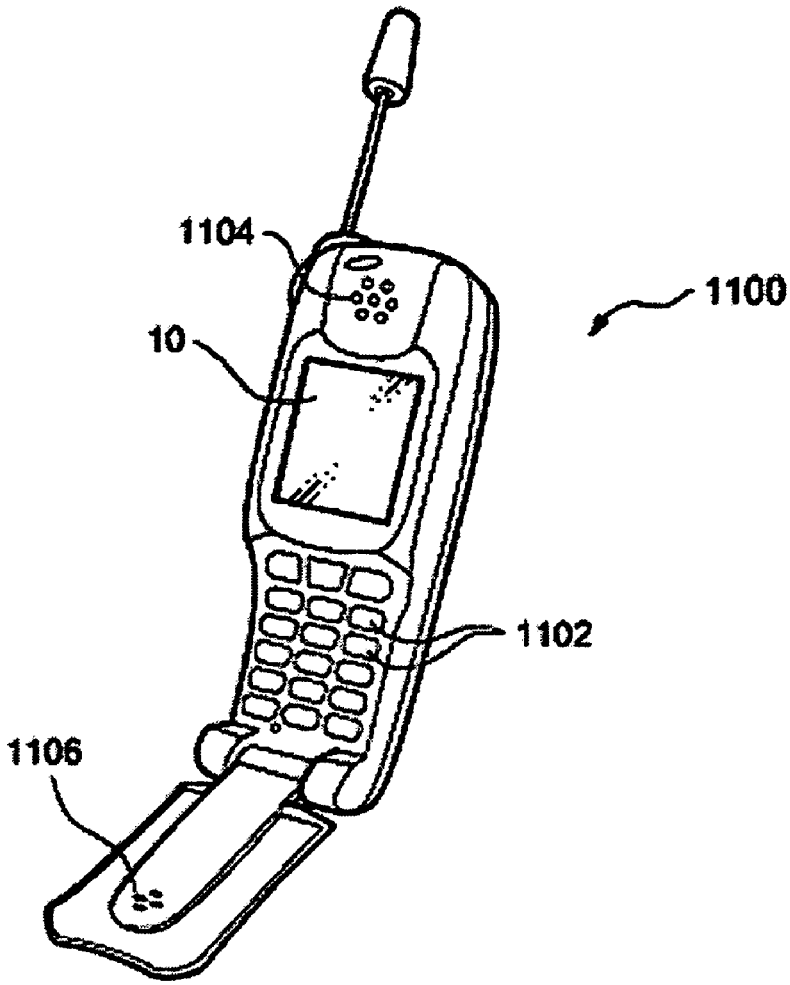
FIG. 15 is a diagram illustrating a mobile phone using an electro-optical device.

First, a mobile phone will be described which has the above-mentioned electro-optical device 10 in its display unit. FIG. 15 is a perspective view representing a configuration of the mobile phone.

In the drawing, a mobile phone 1100 has a plurality of operating buttons 1102, an earpiece 1104, a mouthpiece 1106 and the above-mentioned electro-optical device 10.

Next, a digital still camera using the above-mentioned electro-optical device 10 for its finder will be described.

Figure 16:
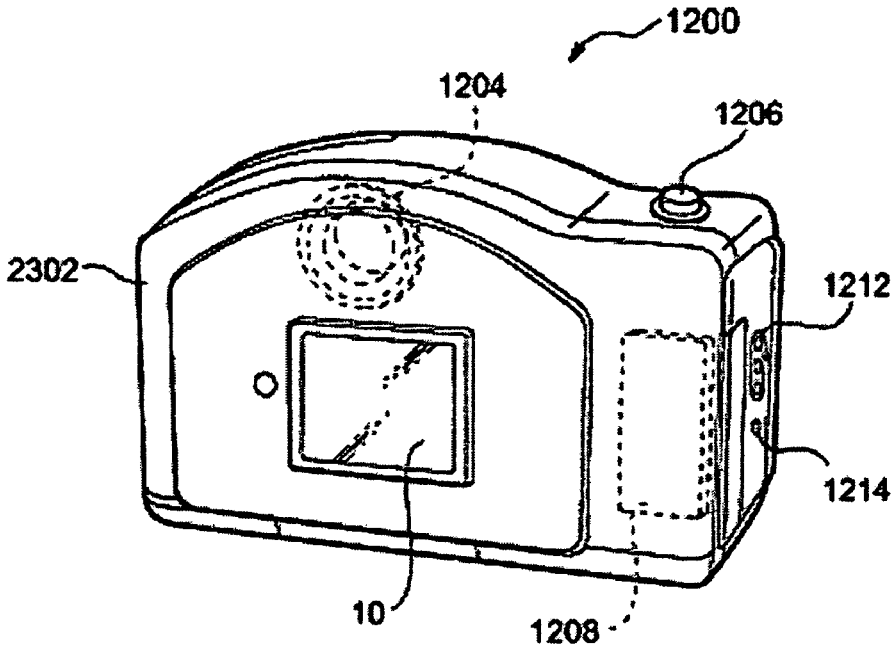
FIG. 16 is a diagram illustrating a digital still camera using an electro-optical device.

FIG. 16 is a perspective view representing the rear surface of the digital still camera. In a film camera, a film is exposed to light by an optical image of a subject, but in a digital still camera 1200, optical image of the subject is subject to photoelectric conversion by an image pickup device such as CCD (Charge Coupled Device), and thereby the image pickup signal is generated and memorized. Here, a display surface of the above-mentioned electro-optical device 10 is provided in a rear surface of the case 1202 in the digital still camera. Since this electro-optical device 10 displays based on the image pickup signal, it acts as a finder that displays the subject. Further, the earpiece 1204 including an optical lens or a CCD is provided in the front side of the case 1202 (the rear side in FIG. 16).

When a photographer confirms the subject image displayed by the electro-optical device 10 and presses a shutter button 1206, the image pickup signal in the CCD at the point of time is transmitted to a memory in a circuit substrate 1208 to be memorized. Further, in the digital still camera 1200, a video signal output terminal 1212 for performing an external display and input/output terminal 1214 for data communication are provided at the side surface of the case 1202.

In addition, as electronic apparatus, other than the mobile phone in FIG. 15 and the digital still camera in FIG. 16, there are many applications such as TV, view-finder type or monitor direct watch type video tape recorder, car navigation device, pager, electronic organizer, calculator, word processor, work station, TV phone, POS terminal, touch panel, etc. Also, it is needless to say that the above-mentioned electro-optical device can be applicable to display unit in each of the above applications. Further, it is not limited to the display unit in the electronic apparatus where picture or character is directly displayed, but it may be applicable to a light source in a printing apparatus used for indirectly forming a picture or character by illuminating a subject.

What is claimed is:

1. A method of driving an electronic circuit comprising:

a driving transistor for controlling a current flowing through a driven element;

a first switching element for turning on or off between a gate and a drain of the driving transistor;

a capacitive element one end of which is connected to the gate of the driving transistor;

a second switching element for turning on or off between the other end of the capacitive element and the drain of the driving transistor;

a third switching element for turning on or off between a signal line and the other end of the capacitive element; and a fourth switching element for cutting off the current flowing through the driven element when turned off, regardless of the control of the driving transistor, wherein the method comprises:

a first step of turning on at least the first and second switching elements, and then turning off the first and second switching elements;

a second step of applying to the signal line a voltage corresponding to a current which is to flow into the driven element while the third switching element is turned on; and a third step of turning off the third switching element, and making the driving transistor keep flowing the current corresponding to the gate voltage of the driving transistor through the driven element by maintaining the fourth switching element in the on-state.

2. The method according to claim 1, wherein, in the first step, the second switching element is turned off, and then the first switching element is turned off.

3. The method according to claim 1, wherein, in the first step, the first and second switching elements are turned on substantially at the same time, and the third switching element is turned on to flow a current between the source and the drain of the driving transistor, and then the first and second switching elements are turned off substantially at the same time.

4. An electronic circuit comprising:

a driving transistor for controlling a current flowing through a driven element;

a first switching element turned on during a first period and turned off during second and third periods, between a gate and a drain of the driving transistor;

a capacitive element one end of which is connected to the gate of the driving transistor;

a second switching element at least turned on at a starting point of time of the first period and turned off during the second and third periods, between the other end of the capacitive element and the drain of the driving transistor;

a third switching element for turning on between the other end of the capacitive element and a signal line to which a voltage corresponding to a current flowing into the driving device is applied during the second period; and a fourth switching element turned off during a first period and turned on during second and third periods, for cutting off the current flowing through the driven element when turned off, regardless of the control of the driving transistor.

5. The electronic circuit according to claim 4, wherein the first and fourth switching elements are different conductivity transistors, and their gates are connected to a common control line.

6. The electronic circuit according to claim 5, wherein the second switching element is the same conductivity transistor as the first switching element, and the gate of the second switching element is also commonly connected to the control line.

7. The electronic circuit according to claim 4, wherein the first to fourth switching elements are all transistors, and their gates are connected to different control lines.

8. The electronic circuit according to claim 4, wherein the driven element is an electro-optical element.

9. The electronic circuit according to claim 8, wherein the electro-optical element is an organic light-emitting diode element.

10. An electro-optical apparatus having pixel circuits at intersections of scan lines and data lines, the scan lines being sequentially selected, and the data lines having applied thereto a voltage corresponding to a current flowing into an electro-optical element, wherein, each of the pixel circuits comprises:

a driving transistor for controlling a current flowing through the electro-optical element;

a first switching element turned on during a first period and turned off during second and third periods, between a gate and a drain of the driving transistor;

a capacitive element one end of which is connected to the gate of the driving transistor;

a second switching element at least turned on at a starting point of time of the first period and turned off during the second and third periods, between the other end of the capacitive element and the drain of the driving transistor;

a third switching element turned on during the second period between the data line and the other end of the capacitive element; and a fourth switching element turned off during a first period and turned on during second and third periods, for cutting off the current flowing through the electro-optical element when turned off, regardless of the control of the driving transistor.

11. An electronic apparatus having the electro-optical apparatus of claim 10.

* * * * *